United States Patent [19]

Bowen et al.

[11] Patent Number: 5,057,038

[45] Date of Patent: Oct. 15, 1991

[54] SHIELDED ELECTRICAL CONNECTION

[75] Inventors: David C. Bowen, Downers Grove; Philip J. Dambach, Naperville; Joseph W. Nelligan, Jr., LaGrange Park; Irvin R. Triner, Willow Springs, all of Ill.

[73] Assignee: Molex Incorporated, Lisle, Ill.

[21] Appl. No.: 587,137

[22] Filed: Sep. 24, 1990

[51] Int. Cl.[5] ..... H01R 9/07

[52] U.S. Cl. ..... 439/497; 439/608

[58] Field of Search ..... 439/494, 497–499, 439/607, 609, 608, 610, 696, 701

[56] References Cited

U.S. PATENT DOCUMENTS

| | | | |
|---|---|---|---|
| 3,912,354 | 10/1975 | Campbell et al. | 439/607 |
| 4,484,792 | 11/1984 | Tengler et al. | 439/736 |
| 4,544,227 | 10/1985 | Hirose | 439/931 |
| 4,758,179 | 9/1988 | Klein et al. | 439/609 |

*Primary Examiner*—Larry I. Schwartz
*Assistant Examiner*—Han D. Vu
*Attorney, Agent, or Firm*—Louis A. Hecht; Stephen Z. Weiss; A. A. Tirva

[57] ABSTRACT

A shielded electrical connector is formed by the mating of upper and lower housing covers and is used with twisted pair cables, each of which includes a pair of signal wires and a drain wire enclosed within an outer insulation. Each pair of terminated signal wires is disposed in a contact module which is positioned in one of a plurality of shielded compartments formed between adjacent separating walls extending from the outer housing covers when the covers are mated with each other. Each of the separating walls has a positioning slot into which a positioning rib on the contact modules may be disposed in order to properly position and retain the contact module in one of the shielded compartments. A ferrule assembly is crimped about the end of the insulation of each of the cables and is coupled to the drain wire of the twisted pair cable. A bus bar coupled to ground terminals disposed in contact modules in the connector is positioned within the connector housing so as to be in contact with each of the ferrule assemblies and includes resilient fingers that engage one of the housing covers to thereby couple the drain wires to the ground terminals and the housing covers. A pull tab may be secured to the rear of the connector housing to aid in extracting the connector from an other connector.

6 Claims, 4 Drawing Sheets

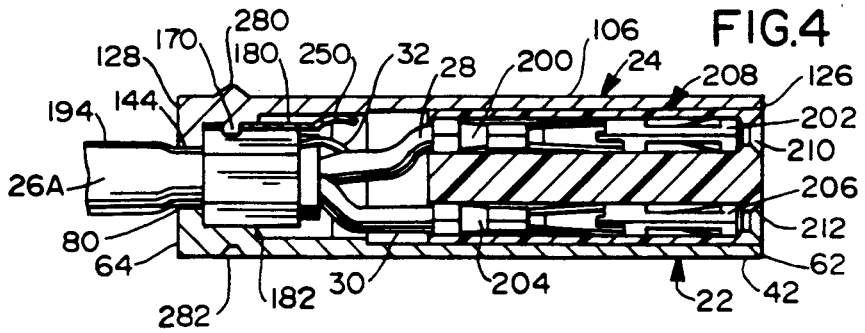
FIG.4
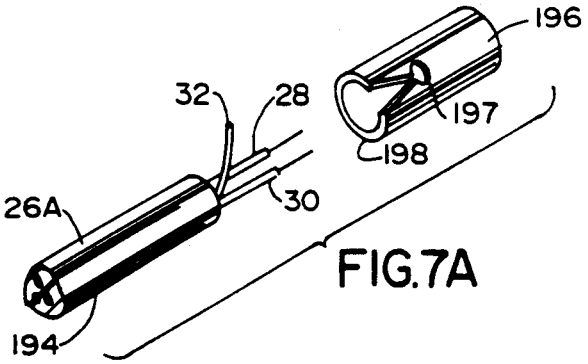
FIG.7A
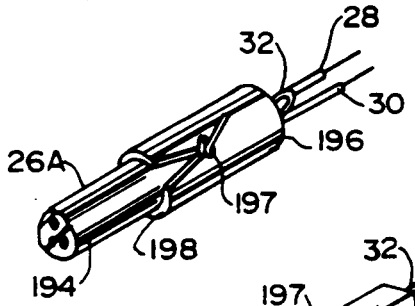
FIG.7B
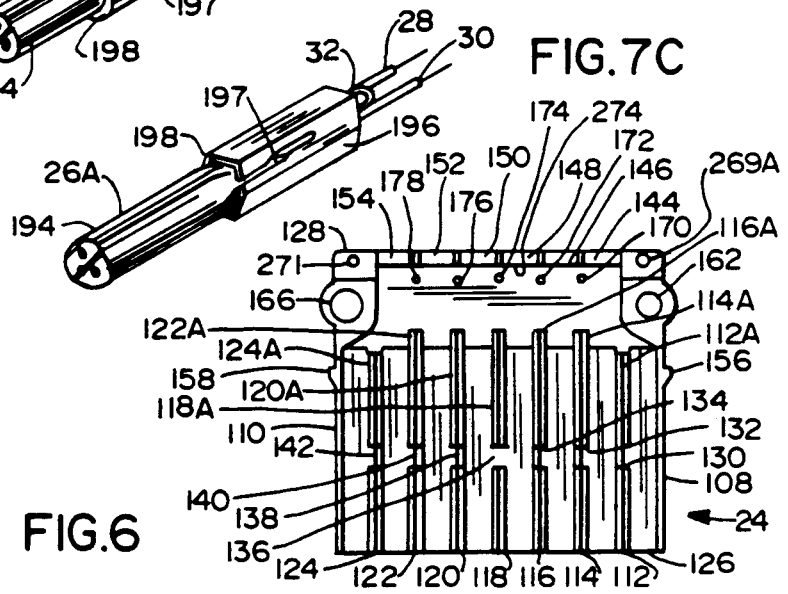
FIG.7C
FIG.6

SHIELDED ELECTRICAL CONNECTION

BACKGROUND OF THE INVENTION

1. Field of the Invention

The present invention relates to a shielded electrical connector, and more particularly, to a new and improved electrical connector providing a separate shielded compartment for each pair of terminated signal wires contained in twisted pair transmission cables and a grounding mechanism for a drain wire in each such cable.

2. Description of the Prior Art

A twisted pair transmission cable includes a twisted pair of signal wires and a drain wire, all of which are enclosed in an outer insulation jacket. These cables are used to interconnect components in telephone switching systems. The signal wires in each such cable normally are terminated with an electrical terminal. These terminals are adapted to be mounted in electrical connectors so that they may be mated with other connectors so as to provide an interface between the various components of the telephone switching system. For example, the cables coupled to a shielded receptacle may be mated to a shielded header.

Due to the type of signals being transmitted over these signal wires and the spacing between adjacent terminals in the connector, the terminated pair of signal wires need to be individually shielded within the electrical connector. One connector for terminating multiple conductors is disclosed in U.S. Pat. No. 4,824,383. The connector disclosed in that patent includes a ground structure having channels formed by walls projecting from upper and lower working surfaces. While the terminated wires are individually shielded from each other by the walls forming the channels in the ground structure, a separate ground structure within the connector housing is required to form the channels for shielding of the individual terminals mounted in the connector. Another high density modular electrical connector is disclosed in U.S. Pat. No. 4,767,345. The connector includes plastic housing modules and an outer molded plastic cover. The terminals in this connector are disposed in separate compartments but the compartments cannot provide any shielding for the individual terminals because the walls of the compartments are plastic. Similarly, PCT Publication No. WO 87/07441 and Japanese Application 62-281281 disclose a connector in which contacts are disposed in retaining channels within the connector housing. These channels are formed by individual housing sections that are mounted within the connector.

While connectors have been made for disposing individual terminated signal wires in separate compartments, these connectors include separate components mounted in the connector housing in order to form the compartments into which the terminated signal wires are disposed. Moreover, these connectors do not provide for an efficient way of coupling to ground potential the drain wires used in twisted pair cables.

SUMMARY OF THE INVENTION

Accordingly, one object of the present invention is to provide a new and improved electrical connector for twisted pair cable having a pair of signal wires and a drain wire.

It is another object of the present invention to provide a new and improved electrical connector wherein individual compartments are formed by the outer upper and lower housing components so that terminals attached to the signal wires may be properly shielded within the connector housing without the necessity of any additional separate grounding structure being provided in the connector housing.

It is yet another object of the present invention to provide a new and improved electrical connector for twisted pair cables having a pair of signal wires and a drain wire in which ferrules are crimped to the end of each of the cables for coupling the drain wire through a bus bar to the outer shield of the connector and to ground terminals disposed in the connector.

It is still another object of the present invention to provide a new and improved electrical connector for twisted pair cables having a pair of signal wires and a drain wire with the terminated signal wires being stacked in contact modules in double rows.

It is still a further object of the present invention to provide a new and improved electrical connector for twisted pair cables having a pair of signal wires and a drain wire where the center-line to centerline spacing between terminals for the signal wires in adjacent cables is very small so as to make the connectors easily stackable.

In accordance with these and many other objects, an embodiment of the present invention comprises a shielded electrical connector for use with twisted pair cables, each of which includes a pair of signal wires and a drain wire enclosed within an outer insulation jacket. Each signal wire is coupled to a terminal. The terminals are disposed in contact modules so that one of the terminals is stacked on top of the other terminal. Upper and lower conductive housing covers are adapted to be mated together so as to form the electrical connector. Each of the housing covers have separating walls extending inwardly so that shielded compartments are formed between adjacent separating walls when the covers are mated with each other. Each of the separating walls has a positioning slot into which a positioning rib on the contact modules may be disposed in order to properly position and retain the contact module in one of the shielded compartments.

In order to couple the drain wire in each twisted pair cable to the outer conductive housing covers and to ground terminals disposed in contact modules in the connector, an inner ferrule may be positioned about the end of the insulation of each of the cables with the drain wire from the cable lying on a flat outer surface of the inner ferrule. A second outer ferrule then may be positioned about at least a portion of the inner ferrule. When the outer ferrule is crimped about the inner ferrule, the drain wire will be captured between the inner and outer ferrules to thereby couple the drain wire to the inner and outer ferrules. Alternatively, the drain wire may be positioned within a wire receiving slot (preferably V-shaped) of a ferrule that is positioned around the end of the insulation of each of the cables after an end portion of the insulation has been removed from the cable. The drain wire is coupled to the ferrule by crimping the ferrule to the outer insulation of the cable. A bus bar coupled to ground terminals disposed in contact modules in the connector is positioned within the connector housing so as to be in contact with each of the ferrules and includes resilient fingers that engage the upper housing cover to thereby couple the drain wires to the ground terminals and the housing covers.

In order to couple the bus bar to the ground terminals, ground or jumper wires coupled to the ground terminals may be positioned between the inner and outer ferrules that are to be crimped about one of the cables when the drain wire is so positioned between the inner and outer ferrules. As a result, when the outer ferrule is crimped about the inner ferrule, the ground wires as well as the drain wire will be captured between the ferrules. Because the ferrule is in contact with the bus bar when the bus bar is positioned in the housing, the ground terminals will be coupled through the ground wires and the crimped ferrules to the bus bar. If the alternate ferrule having a slot is crimped to each of the twisted pair cable, the ground terminals may be coupled to the bus bar by directly securing the ground wire to the bus bar by soldering or the like. In addition, a pull tab may be secured to the rear of the connector housing to aid in extracting the connector from another connector.

BRIEF DESCRIPTION OF THE DRAWINGS

Many other objects and advantages of the present invention will become apparent upon consideration of the following detailed description in conjunction with the drawings in which.

FIG. 4 is a cross-sectional view taken along line 4—4 of FIG. 2 showing a twisted pair cable mounted in a contact module used in the electrical connector of FIGS. 1-3;

FIG. 6 is a bottom view of the upper outer housing cover forming a portion of the shielded electrical connector shown in FIG. 1; and FIGS. 7A-7C show the steps that may be taken in installing a ferrule onto a twisted pair cable and connecting it to the drain wire of such a twisted pair cable.

DETAILED DESCRIPTION OF THE PREFERRED EMBODIMENT

Figure 1:
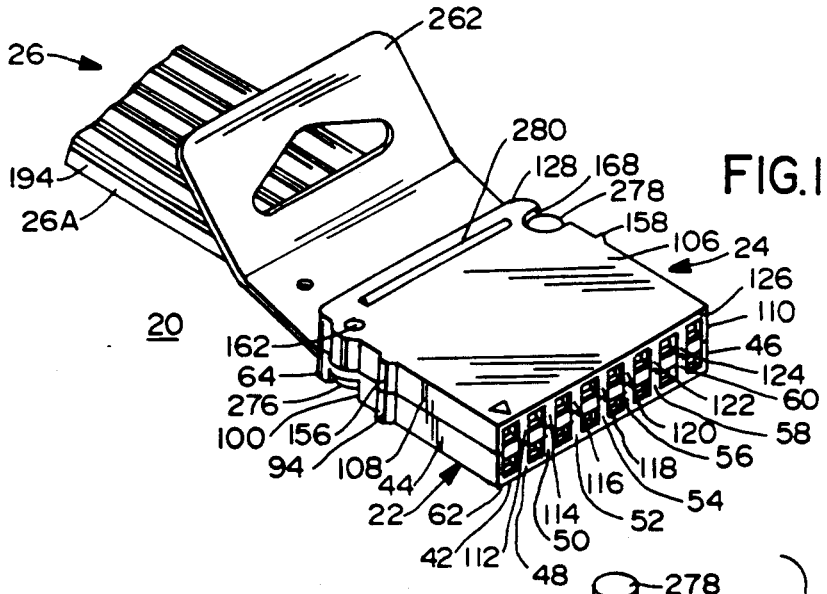
FIG. 1 is a perspective view of a shielded electrical connector embodying the present invention.
Figure 2:
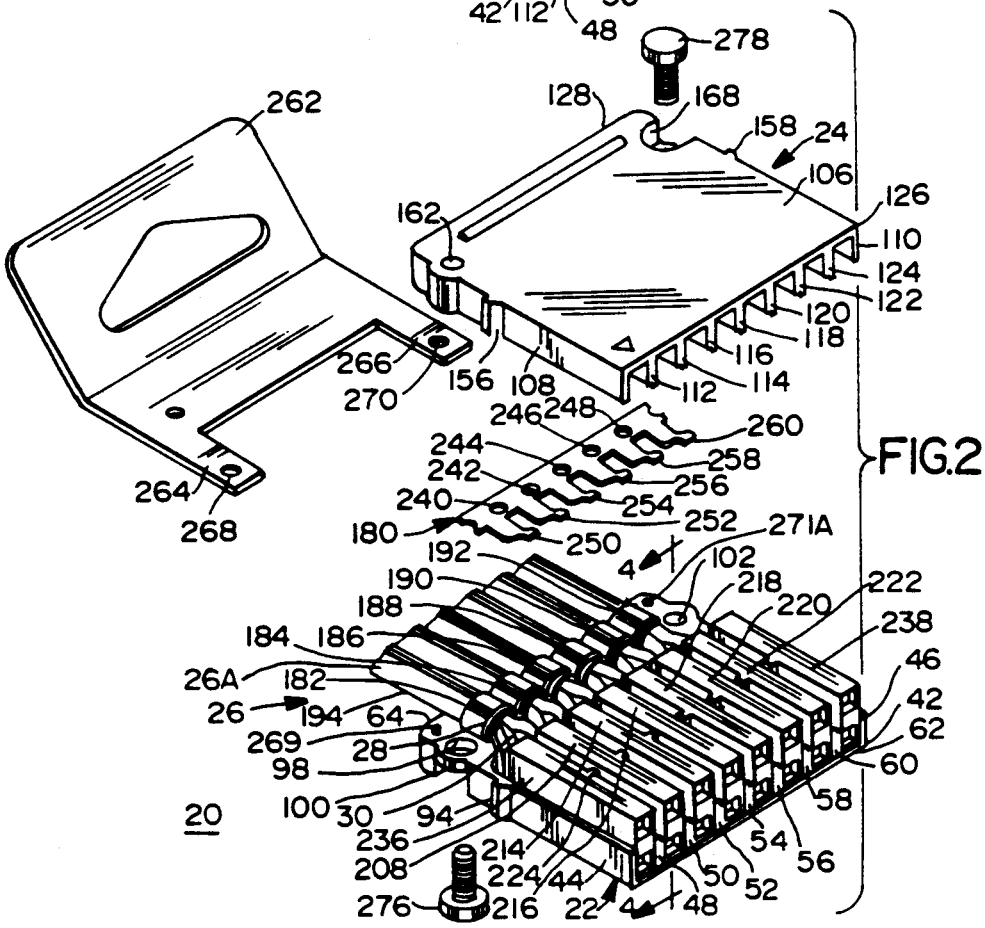
FIG. 2 is a partially exploded, perspective view of the electrical connector of FIG. 1.
Figure 3:
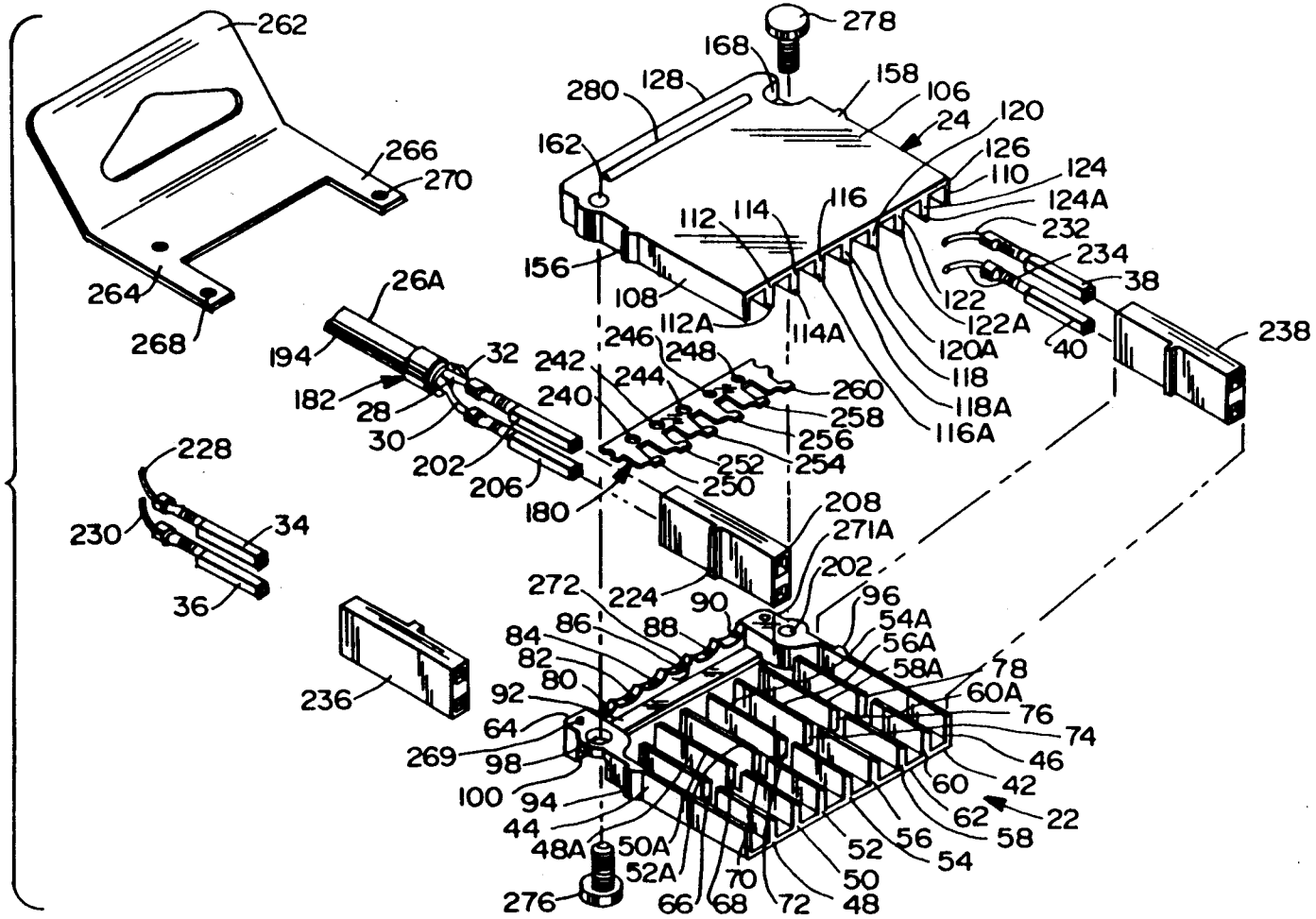
FIG. 3 is an exploded view of the electrical connector of FIG. 1 with certain contact modules and cables not shown.

Referring now more specifically to FIGS. 1-3 of the drawings, therein is disclosed an electrical connector which is generally designated by the numeral 20 and which embodies the present invention. The electrical connector 20 disclosed in FIGS. 1-3 includes a lower connector housing cover 22 and an upper connector housing cover 24. The housing covers 22 and 24 are adapted to be mated together in order to form the electrical connector 20. The electrical connector 20 is designed to terminate twisted pair transmission cables 26. As is disclosed with respect to a cable 26A, each of the cables 26 includes a pair of signal wires 28 and 30 and a drain wire 32. The electrical connector 20 shields each terminated pair of signal wires, such as the signal wires 28 and 30, and provides an interface for each drain wire, such as the drain wire 32, to ground terminals 34, 36, 38 and 40 disposed in the electrical connector 20.

The lower housing cover 22 is made of a conductive material such as a zinc die-cast. The lower housing cover 22 includes an outer base wall 42 from which projects outer sidewalls 44 and 46 and a series of separating or channel forming walls 48, 50, 52, 54, 56, 58 and 60 disposed between the sidewalls 44 and 46. Each of the separating walls 48, 50, 52, 54, 56, 58 and 60 extend from a front mating end 62 of the lower housing cover 22 toward a rear cable receiving end 64 and has stepped top edges 48A, 50A, 52A, 54A, 56A, 58A and 60A, respectively. In addition, the walls 48, 50, 52, 54, 56, 58 and 60 respectively include positioning slots 66, 68, 70, 72, 74, 76 and 78 (see FIG. 3) spaced inwardly from the front mating end 62 of the lower housing cover 22. A series of semi-circular cable receiving recesses 80, 82, 84, 86, 88 and 90 are disposed on the base wall 42 near the rear cable receiving end 64 of the lower housing cover 22 for retaining the cables 26. A ledge 92 is disposed inwardly of the rear wall 64 and adjacent to the recesses 80, 82, 84, 86, 88 and 90. The outer sidewalls 44 and 46 include latching shoulders 94 and 96, respectively, that are adapted to mate with retention clips of a header or the like (not shown) when the electrical connector 20 is mated with such a header. A screw hole 98 extends from a recess in the sidewall 44 near the rear cable receiving end 64 and a threaded screw receiving hole 102 is located in the sidewall 46 near the cable receiving end 64.

As was the case with respect to the lower housing cover 22, the upper housing cover 24 is made of a conductive material such as a zinc die-cast. The upper housing cover 24 includes an outer top wall 106 from which projects outer sidewalls 108 and 110. A series of separating walls 112, 114, 116, 118, 120, 122 and 124 project from the top wall 106 in between the sidewalls 108 and 110. Each of the separating walls 112, 114, 116, 118, 120, 122 and 124 extends from a front mating end 126 towards a rear cable receiving end 128 of the upper housing cover 24 and has stepped bottom edges 112A, 114A, 116A, 118A, 120A, 122A and 124A, respectively. In addition, the walls 112, 114, 116, 118, 120, 122 and 124 respectively include positioning slots 130, 132, 134, 136, 138, 140 and 142 which will be respectively in alignment with the slots 66, 68, 70, 72, 74, 76 and 78 when the covers 22 and 24 are mated together. A series of semi-circular cable receiving recesses 144, 146, 148, 150, 152 and 154, which will be respectively in alignment with recesses 80, 82, 84, 86, 88 and 90 when the covers 22 and 24 are mated together, are disposed on the upper wall 106 near the rear cable receiving end 128 for retaining the cables 26. The outer sidewalls 108 and 110 include latching shoulders 156 and 158, respectively, that, along with the latching shoulders 94 and 96 on the lower housing cover 22, are adapted to mate with retention clips of the above-referred to header when the electrical connector 20 is mated with such a header. A threaded screw receiving hole 162 is located in the sidewall 108 near the cable receiving end 128 and a screw hole 166 extends from a recess 168 in the sidewall 110 near the rear cable receiving end 128.

A series of bus bar retention bosses 170, 172, 174, 176 and 178 project out from the outer top wall 106 between the separating walls 112, 114, 116, 118, 120, 122 and 124 and the cable receiving recesses 144, 146, 148, 150, 152, and 154. As will be discussed hereinafter, the bus bar retention bosses 170, 172, 174, 176 and 178 are adapted to properly position a bus bar 180 when the electrical connector 20 is formed by the mating of the connector housing covers 22 and 24.

Figure 5A:
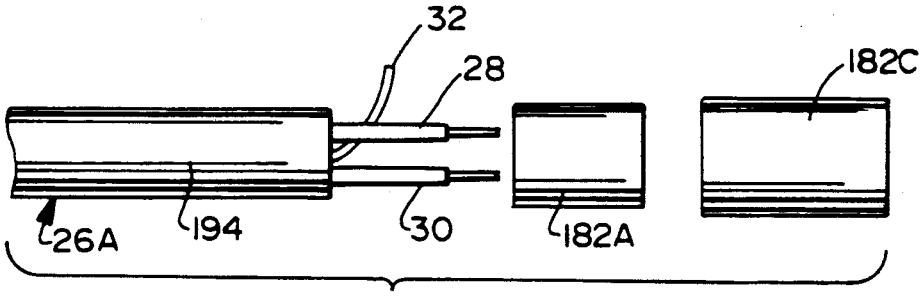
FIGS. 5A—5E show the steps that may be taken in installing inner and outer ferrules onto a twisted pair cable so that the drain wire of such a twisted pair cable is captured between the ferrules (FIG. 5C being a cross-sectional view taken along lines 5C—5C of FIG. 5B and FIG. 5E being a cross-sectional view taken along line 5E—5E of FIG. 5D.
Figure 5B:
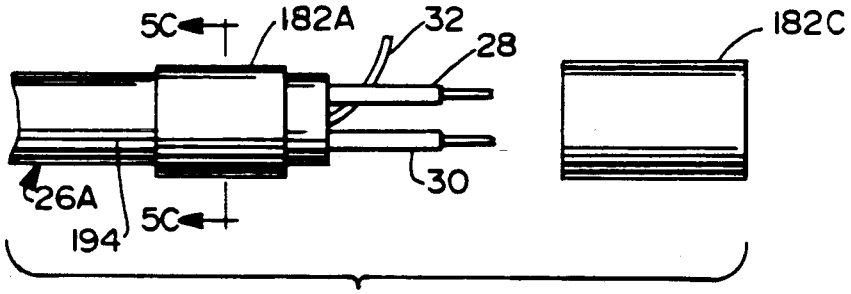
Figure 5D:
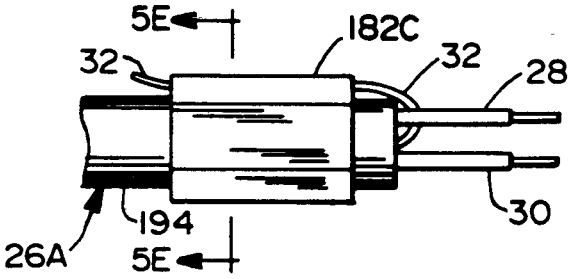
Figure 5C:
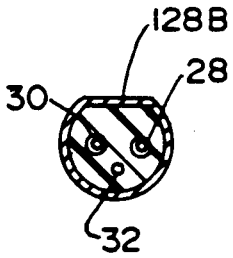
Figure 5E:
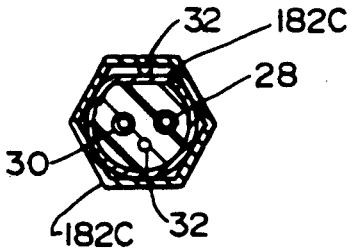

In order to couple the drain wires of the cables 26 to the bus bar 180, ferrule assemblies 182, 184, 186, 188, 190 and 192 are positioned about the ends of the cables 26 and the drain wires in the cables 26 are secured to the ferrule assemblies 182, 184, 186, 188, 190 and 192. As is best seen in FIGS. 3 and 5A–5E of the drawings in connection with the cable 26A, each of the cables 26 that extends to the cable receiving ends 64 and 128 includes the pair of signal wires 28 and 30 and the drain wire 32. In the case of the cable 26A, a generally cylindrical inner ferrule 182A is positioned about an outer insulation 194 of the cable 26A (see FIGS. 5A–5B). As seen in FIG. 5C, the inner ferrule 182A has a generally flat surface 182B and the drain wire 32 is bent backwards onto this generally flat surface (see FIG. 5B). Thereafter, an outer ferrule 182C having an inner diameter greater than the outer diameter of the inner ferrule 182A is slid over the outer insulation 194 and about at least a portion of the inner ferrule 182A such that the drain wire 32 is disposed between the flat surface 182B of the inner ferrule 182A and the outer ferrule 182C. The outer ferrule 182C then is hex-crimped so that its inner side walls engage the inner ferrule 182A and captures the drain wire 32 between the outer ferrule 182C and the flat surface 182B of the inner ferrule 182A (see FIGS. 5D–5E). A number of the drain wires 32, for example, three such drain wires 32, may be disposed between the inner ferrule 182A and the outer ferrule 182C prior to crimping. In addition to coupling the drain wires, such as the drain wire 32, to the bus bar 180, the ferrule assemblies 182, 184, 186, 188, 190 and 192 also provide shielding between each of the twisted pair cables 26 near the rear end 64 and 128 of the covers 22 and 24 in the space rearward of the separating walls 48, 50, 52, 54, 56, 58 and 60 in the case of the cover 22 and the separating walls 112, 114, 116, 118, 120, 122 and 124 in the case of the cover 24.

Alternatively, the drain wire 32 may be coupled to the bus bar 180 by a single generally cylindrical ferrule, such as the ferrule 196 shown in FIGS. 7A–7C in connection with the cable 26A. When such a ferrule 196 is utilized, the ferrule 196 is positioned about the outer insulation 194 of the cable 26A (see FIG. 7A). Prior to positioning the ferrule 196 on the outer insulation 194, the drain wire 32 is bent back onto the outer insulation 194 of the cable 26A. A V-shaped slot 197 or a similarly functioning keyhole shaped slot (not shown) extends from one end 198 of the ferrule 196 and the drain wire 32 is positioned within this slot 197 (see FIG. 5B). The ferrule 196 is then hex-crimped so that the V-shaped slot 197 is collapsed and the drain wire 32 is secured to and electrically coupled to the ferrule 196 (see FIG. 7C).

As illustrated in connection with the cable 26A, a conductor 200 in the signal wire 28 is terminated to a female terminal 202 and a conductor 204 in the signal wire 30 is terminated to a terminal 206 after the ferrule assemblies 182, 184, 186, 188, 190 and 192 have been crimped to the cables 26. As best seen in FIGS. 3–4 of the drawings, the terminals 202 and 206 are inserted into a contact module 208. The contact module 208 has an upper terminal receiving channel 210 into which the terminal 202 is inserted and a lower terminal receiving channel 212 into which the terminal 206 is inserted. When the terminals 202 and 206 are so inserted into the contact module 208, the terminals 202 and 206 effectively are stacked in a vertically aligned row within the contact module 208. As is the case with respect to all of the contact modules 208, 214, 216, 218, 220 and 222, the contact module 208 includes a positioning rib 224 which extends along a sidewall 226 of the contact module 208. As will be described in more detail hereinafter, positioning ribs, such as the positioning rib 224, aid in properly positioning the contact modules 208, 214, 216, 218, 220 and 222 within the channels formed when the separating walls 48, 50, 52, 54, 56, 58 and 60 of the lower housing cover 22 are mated with the separating walls 112, 114, 116, 118, 120, 122 and 124 of the upper housing cover 24.

The ground terminals 34, 36, 38 and 40 are coupled to jumper wires 228, 230, 232 and 234, respectively. Two of these ground terminals 34 and 36 are inserted into a contact module 236 similar to the contact module 208 and the other two ground terminals 38 and 40 are inserted into a similar contact module 238. The jumper wires 228, 230, 232 and 234 extend to and are coupled to the bus bar 180. When the ferrule assemblies 182, 184, 186, 188, 190 and 192 are utilized, the jumper wires 228 and 230 may be inserted between the inner ferrule 182A and the outer ferrule 182C of the ferrule assembly 182 when the drain wire 32 is so positioned between the inner ferrule 182A and the outer ferrule 182C. Thus, the ground terminals 228 and 230 will be coupled to the ferrule assembly 182 when the outer 182C is crimped onto the inner ferrule 182A and will be coupled to the bus bar 180 through the ferrule assembly 182. Similarly, the jumper wires 232 and 234 can be coupled to the ferrule assembly 192 so as to be coupled through the ferrule assembly 192 to the bus bar 180. If a single ferrule, like the ferrule 196, is utilized about the twisted pair cables 26, the jumper wires 228, 230, 232 and 234 may be directly coupled to the bus bar 180 by soldering or the like.

The bus bar 180 has retention holes 240, 242, 244, 246 and 248 so that the bus bar 180 may be retained on the bus bar retention bosses 170, 172, 174, 176, and 178, respectively, and lie against the ferrule assemblies 182, 184, 186, 188, 190 and 192 when the electrical connector 20 is assembled. Resilient fingers 250, 252, 254, 256, 258 and 260 extend from an edge of the bus bar 180 and will engage the inner surface of the top outer housing cover 24 when the electrical connector 20 is assembled (see FIG. 4). As a result, the bus bar 180 and the ferrule assemblies 182, 184, 186, 188, 190 and 192 act as interfaces between the drain wires 32 in the cables 26 and the ground terminals 34, 36, 38 and 40. In addition, the bus bar 180 interconnects the ground terminals 34, 36, 38 and 40 to the outer housing covers 22 and 24.

After the terminals, such as the terminals 202 and 206 connected to the signal wires in the cables 26, such as the signal wires 28 and 30 in the cable 26A, are mounted in the contact modules 208, 214, 216, 218, 220 and 222, the electrical connector 20 may be assembled. The contact modules 208, 214, 216, 218, 220 and 222 are positioned in the channels formed between the separating walls 48, 50, 52, 54, 56, 58 and 60 of the lower housing cover 22. In so positioning the contact modules 208, 214, 216, 218, 220 and 222, the positioning ribs, like the positioning rib 224 on the contact module 208, will slide into the slots 66, 68, 70, 72, 74, 76 and 78 and aid in properly positioning these contact modules 208, 214, 216, 218, 220 and 222 in between the separating walls 48, 50, 52, 54, 56, 58 and 60. With the contact modules 208, 214, 216, 218, 220 and 222 so positioned, the cables 26 will rest within the cable receiving recesses 80, 82, 84, 86, 88 and 90 and the ferrule assemblies 182, 184, 186, 188, 190 and 192 on the cables 26 will be positioned on the ledge 92. In addition, the ground contact module 236 similarly is positioned between the sidewall 44 and the separating wall 48 and the ground contact module 218 is positioned between the sidewall 46 and the separating wall 60. The bus bar 180 then is positioned on the ferrule assemblies 182, 184, 186, 188, 190 and 192. A pull tab 262 also may be positioned such that legs 264 and 266 are disposed on the upper surfaces of the sidewalls 44 and 46 with a hole 268 in the leg 264 in alignment with a peg 269 on the cover 22 and a blind mating hole 269A on the cover 24 and a hole 270 in the leg 266 in alignment with a peg 271 on the cover 24 and a blind mating hole 271A on the cover 22. When the covers 22 and 24 are mated together, the pegs 269 and 271 will aid in properly retaining the pull tab 262 in place extending outwardly from the rear ends 64 and 128.

Thereafter, the upper connector housing cover 24 may be mated with the lower connector housing cover 22 in order to complete the electrical connector 20. When the upper housing cover 24 is mated to the lower housing cover 22, the stepped edges 112A, 114A, 116A, 118A, 120A, 122A and 124A of the separating walls 112, 114, 116, 118, 120, 122 and 124 interfit with the stepped edges 48A, 50A, 52A, 54A, 56A, 58A and 60A of the separating walls 48, 50, 52, 54, 56, 58 and 60 because the stepped edges 112A, 114A, 116A, 118A, 120A, 122A and 124A of the separating walls 112, 114, 116, 118, 120, 122 and 124 are complementary to the stepped edges 48A, 50A, 52A, 54A, 56A, 58A and 60A of the separating walls 48, 50, 52, 54, 56, 58 and 60. The mating of the separating walls 48, 50, 52, 54, 56, 58 and 60 and 112, 114, 116, 118, 120, 122 and 124 complete the forming of the shielded channels or compartments for each of the contact modules 208, 214, 216, 218, 220 and 222.

In addition, the cables 26 also will be captured in the cable receiving recesses 80, 82, 84, 86, 88 and 90 in the case of the lower housing cover 22 and the cable receiving recesses 144, 146, 148, 150, 152 and 154 in the case of the upper housing cover 24. When the cables 26 are so positioned in the cable receiving recesses 80, 82, 84, 86, 88 and 90 and the cable receiving recesses 144, 146, 148, 150, 152 and 154, the ferrule assemblies 182, 184, 186, 188, 190 and 192 will rest on the ledge 92 adjacent the rear cable receiving end 64 and will contact an inner surface 272 of the rear end wall 64. Similarly, the ferrule assemblies 182, 184, 186, 188, 190 and 192 will contact an inner surface 274 of the rear end 128 of the cover 24 (see FIGS. 4 and 6). The resulting contacting of the ferrule assemblies 182, 184, 186, 188, 190 and 192 against the inner surfaces 272 and 274, respectively, of the rear ends 64 of the cover 22 and the rear end 128 of the cover 24 provides a cable strain relief for the cables 26.

Moreover, the bus bar 180 will be retained by positioning the bus bar retention bosses 170, 172, 174, 176 and 178 in the retention holes 240, 242, 244, 246 and 248 in the bus bar 180. As a result, the bus bar 180 will be forced against the ferrule assemblies 182, 184, 186, 188, 190 and 192 and the fingers 250, 252, 254, 256, 258 and 260 will make contact with the upper housing cover 24 such that the drain wires in the cables 26, such as the drain wire 32 in the cable 26A, will be coupled to the ground terminals 34, 36, 38 and 40 through the ferrule assemblies 182, 184, 186, 188, 190 and 192 and to the covers 22 and 24 of the electrical connector 20 through the ferrule assemblies 182, 184, 186, 188, 190 and 192 and the bus bar 180. In order to secure the upper connector housing cover 24 to the lower connector housing cover 22, a screw 276 is inserted through the screw hole 98 and engaged in the threaded screw receiving hole 162 such that the head of the screw 276 is disposed in the recess 100. Similarly, a screw 278 is inserted through the screw hole 166 and is engaged in the threaded screw receiving hole 102 such that the head of the screw 278 is disposed in the recess 168.

Advantageously, a shielded compartment between adjacent separating walls 48, 50, 52, 54, 56, 58 and 60 in the case of the lower outer housing cover 22 and separating walls 112, 114, 116, 118, 120, 122 and 124 in the case of the upper outer housing cover 24 is provided for each of the contact modules 208, 214, 216, 218, 220 and 222 without the necessity of a separate ground structure or components because the separating walls 48, 50, 52, 54, 56, 58 and 60 and 112, 114, 116, 118, 120, 122 and 124 extend respectively from the outer housing covers 22 and 24. Moreover, with adjacent ones of the contact modules 208, 214, 216, 218, 220 and 222 shielded from each other by the outer housing covers 22 and 24, the center-line to center-line spacing between the terminals, such as the terminals 202 and 206, in those contact modules 208, 214, 216, 218, 220 and 222 can be made relatively small. For example, the center-line to center-line spacing maybe approximately 0.125 inches. In addition, a group of electrical connectors 20 may be stacked one on top of each other. In this regard, a ridge 280 is provided on the outer top wall 106 of the cover 24 and a corresponding notch or groove 282 is provided on the outer base wall 42 of the cover 22 (see for example, FIGS. 1 and 4). When another connector like the connector 20 is positioned on top of the connector 20, the ridge 280 will fit into the notch 282 on that other connector 20.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electrical connector for terminating a plurality of cables, each of said cables has at least one signal wire and a drain wire, said electrical connector comprising:

first and second conductive outer housing means adapted to be mated together, said first outer housing means having a first base wall and first opposed sidewalls extending from said first base wall between a front mating end of said electrical connector and a rear wire receiving end of said electrical connector and said second outer housing means having a second base wall and second opposed sidewalls extending from said second base wall between said mating end and said rear wire receiving end;

a plurality of first separating walls extending from said first base wall between said first sidewalls, each of said first sidewalls having a first mating edge;

a plurality of second separating walls extending from said second base wall between said second sidewalls, each of said second sidewalls having a second mating edge;

a plurality of contact modules into which is received terminals connected to said signal wires;

a plurality of shielded compartments in which said contact modules are positioned, said shielded compartments being formed by adjacent ones of said first and second separating walls when said first and second outer housing means are mated together such that said first mating edges of said first separating walls mate with corresponding ones of said second mating edges of said second sidewalls.

2. The electrical connector as set forth in claim 1 wherein each of said first mating edges has a stepped edge and each of said second mating edges has a stepped edge, said first and second mating edges being complementary so as to interfit together when said first and second outer housing means are mated together.

3. The electrical connector as set forth in claim 1 including fastener means to secure said first and second outer housing means together.

4. The electrical connector as set forth in claim 1 wherein said terminals connected to said signal wires are mounted in said contact modules so as to be stacked into two rows between said first and second outer housing means.

5. The electrical connector as set forth in claim 1 wherein the center-line to center-line spacing between terminals disposed in adjacent contact modules is about 0.125 inches.

6. The electrical connector as set forth in claim 1 wherein said first and second separating walls include positioning slots and each of said contact modules includes a positioning rib that is adapted to be disposed in one of said positioning slots for positioning said contact module in between adjacent ones of said mated first and second separating walls.

* * * * *